US006276086B1

(12) United States Patent
Keaton

(10) Patent No.: US 6,276,086 B1
(45) Date of Patent: Aug. 21, 2001

(54) MAGNETIC TRIGGER COVER

(75) Inventor: Donnie G. Keaton, Lebanon, TN (US)

(73) Assignee: Mitchell Hunt, Murfreesboro, TN (US); a part interest ( * ) Notice: Subject to any disclaimer, the term of this patent is extended or adjusted under 35 U.S.C. 154(b) by 0 days.

(21) Appl. No.: 09/466,684

(22) Filed: Dec. 20, 1999

Related U.S. Application Data

(60) Provisional application No. 60/113,106, filed on Dec. 21, 1998.

(51) Int. Cl.[7] ..... F41A 17/54
(52) U.S. Cl. ..... 42/70.07; 42/70.07
(58) Field of Search ..... 42/70.06, 70.07, 42/70.11, 70.01

(56) References Cited

U.S. PATENT DOCUMENTS

| | | | | |
|---|---|---|---|---|
| 1,686,482 | | 10/1928 | Windle | 42/70.07 |
| 1,887,308 | | 11/1932 | Jessup | 42/70.07 |
| 3,066,433 | | 12/1962 | Rogers et al. | 42/70.07 |
| 3,422,560 | | 1/1969 | Foote et al. | 42/70.07 |
| 4,030,221 | * | 6/1977 | Doobenen et al. | 42/70.07 |
| 4,067,132 | | 1/1978 | Smith | 42/66 |
| 4,457,091 | | 7/1984 | Wallerstein | 42/70.06 |
| 4,563,827 | | 1/1986 | Heltzel | 42/70.06 |
| 4,682,435 | | 7/1987 | Heltzel | 42/70.01 |
| 4,763,431 | | 8/1988 | Allan et al. | 42/70.11 |
| 4,987,693 | | 1/1991 | Brooks | 42/70.11 |
| 5,016,376 | | 5/1991 | Pugh | 42/70.11 |
| 5,090,148 | | 2/1992 | Brooks | 42/70.11 |
| 5,123,193 | | 6/1992 | Pugh | 42/70.11 |
| 5,392,552 | | 2/1995 | McCarthy et al. | 42/70.07 |
| 5,419,068 | | 5/1995 | Pages et al. | 42/70.07 |
| 5,437,119 | | 8/1995 | Womack | 42/70.07 |
| 5,450,684 | | 9/1995 | Harris | 42/70.07 |
| 5,549,957 | | 10/1995 | Winer | 42/70.07 |
| 5,560,135 | | 10/1996 | Ciluffo | 42/70.07 |
| 5,647,158 | * | 7/1997 | Esklinen et al. | 42/70.07 |
| 5,768,819 | * | 6/1998 | Neal | 42/70.07 |
| 5,918,402 | * | 7/1999 | Weinraub | 42/70.07 |

* cited by examiner

*Primary Examiner*—J. Woodrow Eldred
(74) *Attorney, Agent, or Firm*—Ware, Fressola, Van Der Sluys & Adolphson LLP

(57) ABSTRACT

A trigger cover has two half-shells enclosing the trigger guard and immobilizing the trigger of a gun. The half-shells are held together magnetically, such that an adult level of grip and force is required to separate them. The magnetic force is adjustable by adjusting the gap between a magnet and another magnet or catch piece. Guide pins provide a linear or axial separation path with respect to the magnetic force. The outside surfaces are smooth so that a good grip is required for separation of the half-shells.

23 Claims, 3 Drawing Sheets

MAGNETIC TRIGGER COVER

This application claims priority to my provisional application Ser. No. 60/113,106 filed Dec. 21, 1998.

BACKGROUND OF THE INVENTION

This invention relates to firearms safety and more particularly to a trigger blocking device which is intended to be a child safety aid. The device covers the trigger guard area of a gun with two smooth half-shells that are matingly engageable and held together by at least one permanent magnet with adjustable magnetic force such that they are not separable by children.

Trigger locks are well known in the art. For example, it is known to use two half-shells which fixedly lock together with a key lock mechanism to form a trigger lock. However, the drawback of this arrangement is the time consuming reliance on a key which has to be located and inserted before the gun can be fired. It is also known to use latching or snap-together half-shells which will prevent accidental firing stemming from dropping the gun or other movement, but which are easily removable by anyone, including a child. It is also known to use a pseudo-key wherein two half-shells appear to lock via a key lock with a tumbler; however, in actuality the half shells are releasable from a locked position by pushing in the pseudo-key. The drawback of this arrangement is that once a child observes the operation of this device, the child will not be misled by the appearance of the pseudo-key in the future. It is also know to use electronic keypads with access codes that electronically control the release of a trigger lock. The drawbacks associated with such an arrangement are a reliance on a battery, and the time consuming process of entering a code on a key pad. It is also known to use electronic voice activated release of a trigger lock. The drawbacks of this arrangement are reliance on a battery, overall complexity of the device, and having to make a significant sound to release the gun. This sound could alert the target to the presence of the gun user.

SUMMARY OF THE INVENTION

Therefore the objects of the invention include: providing a trigger blocking device which deters children from firing the gun,

- providing a trigger blocking device that is removable without any external key,
- providing a trigger blocking device for a gun which does not rely on a battery or electric power,
- providing a trigger blocking device which has an adjustable level of force required to remove it from the gun,
- providing a trigger blocking device which requires the grip of an adult to remove it from the gun, and
- providing a trigger blocking device which can be released without generating unwanted noises that could alert a target to the presence of the gun user.

The foregoing objects of the invention are carried out in a trigger cover for a gun having a frame, a trigger guard mounted on the frame, and a trigger located within the trigger guard. The trigger cover has two complementary and separable half-shells which are matingly engageable and which together define a cavity between the half-shells, the cavity sized and configured to substantially receive and immobilize the trigger. One of the half-shells includes at least one magnet(s) and the other of the half-shells includes at least one of a magnet or a magnetic catch piece cooperating to magnetically attract the half-shells together when the half-shells are matingly engaged. The half-shells are separable by applying force to overcome the force of the magnetic attraction between the half-shells for removing the trigger cover and exposing the trigger. Additionally, the half-shells enclose the trigger guard.

According to additional aspects of the invention, the half-shells engage and separate with substantially axial movement opposite to and sufficient to overcome the magnetic attraction between the half-shells. Also, the outside surface of the engaged half-shells is substantially smooth, whereby a substantial level of grip is required to separate the engaged magnetically attracted half-shells.

Accordingly to other aspects of the invention the magnetic attraction of the least one magnet is adjustable to hold the half-shells together by an adjusted force. Also, the magnetic attraction is adjustable by adjusting a gap between the at least one magnet and the other magnet or magnetic catch piece. The other magnet or magnetic catch pieces are associated with one or more screws which may be turned to adjust the gap and strength of force.

According to other aspects of the invention, there are at least two spaced-apart sets of magnets and magnets or catch pieces.

According to another aspect of the invention, the half-shells or one of them define trigger blocking posts adjacent the trigger, so that it may not be cocked or released by other mechanisms of the gun. The trigger blocking posts may include one trigger post having adjustable spacer means to adapt the trigger cover to a variety of guns.

Other, more particular objects and features of the invention will be in part recognized by those skilled in the art and will in part appear from the following description of the preferred embodiments and the claims, taken together with the drawings.

BRIEF DESCRIPTION OF DRAWINGS

The same reference numerals refer to the same elements throughout the figures. The drawings are not to any particular scale.

DETAILED DESCRIPTION

Figure 1:
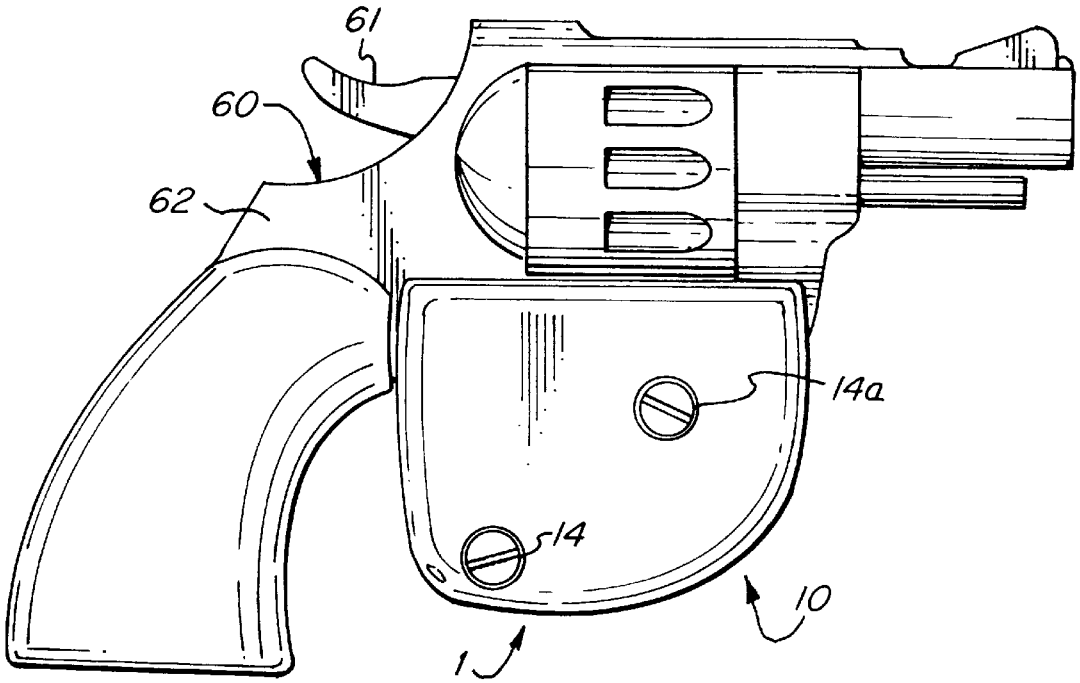
FIG. 1 is a right side elevation view of the present invention trigger cover on a gun.
Figure 2:
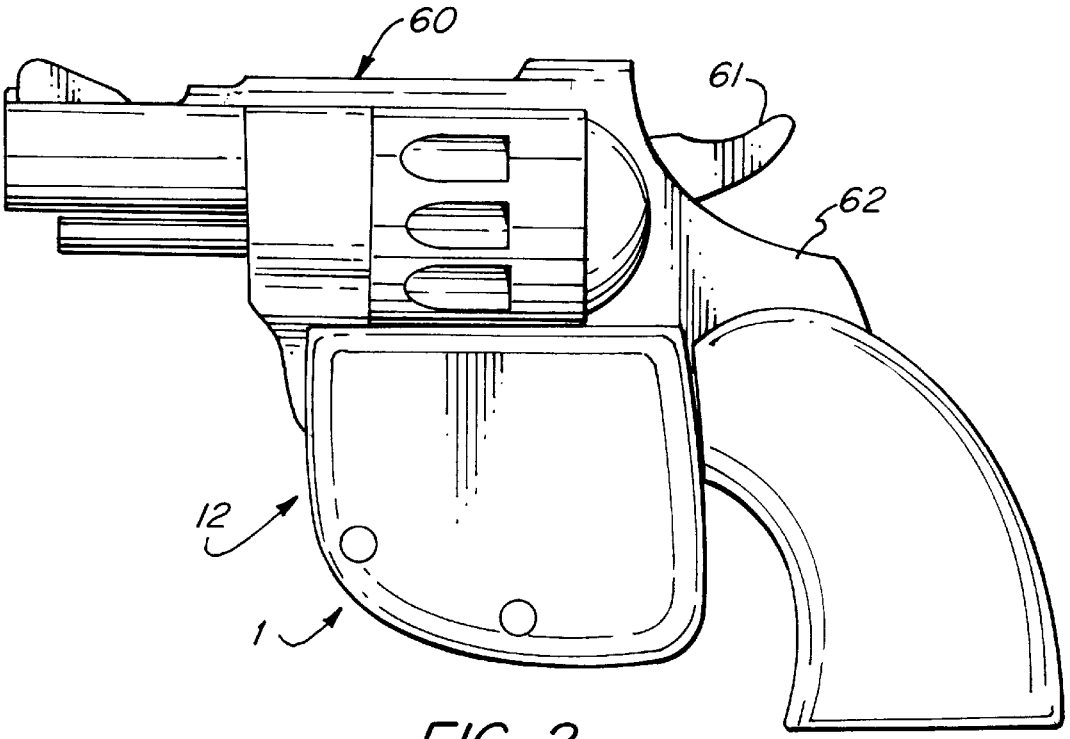
FIG. 2 is a left side elevation view of the trigger cover and gun of FIG. 1.
Figure 3:
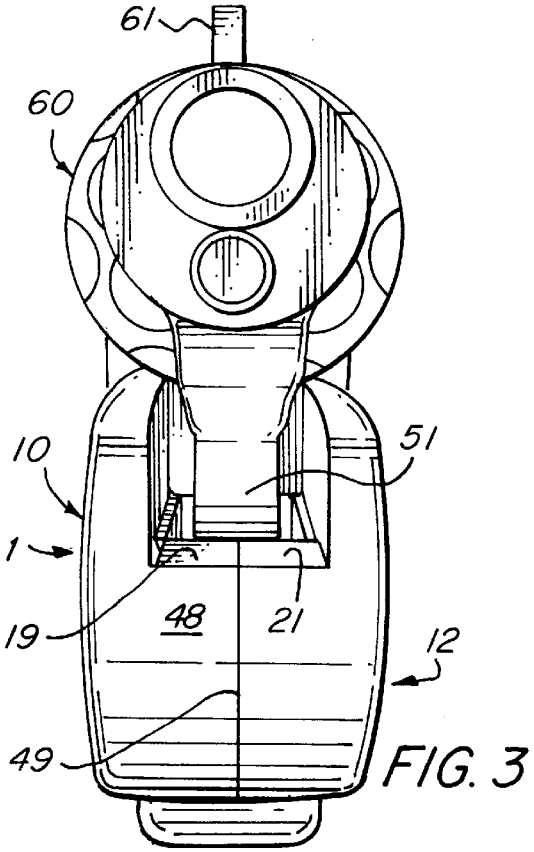
FIG. 3 is a front end view of the trigger cover and gun of FIG. 1.

Referring to the drawings, a gun 60 of the revolver type is shown in FIGS. 1–3 and 6–7. The revolver is of a conventional construction having a frame 62, trigger guard 51, trigger 50 and hammer 61 that may be drawn back manually as well as through a lever mechanism (not shown) connected to the trigger 50. However, if the trigger 50 is immobilized from forward and rearward movement, then the revolver cannot be fired, even through manual movement of the hammer 61. Therefore, it is important to immobilize the trigger 50. This is accomplished by means of a trigger cover 1 of the present invention as explained below.

The trigger cover 1 generally comprises half-shells 10 and 12, which engage together to enclose the trigger guard 51 and immobilize the trigger 50. The right side half-shell 10 has a side wall 11 from which flange 19 extends to form the lower peripheral portion of half-shell 10. The inside of wall 11 and flange 19 generally define a right cavity 15. Left half-shell has a side wall 13 and flange 21 forming the lower peripheral portion of half-shell 12. The side wall 13 and flange 21 form a left half-shell cavity 17. The half-shells 10 and 12 matingly engage to substantially cover the trigger guard 51 on the gun 60 within the cavities 15, 17, and present a smooth outside surface 48 of the trigger cover 1 where the two flanges abut at 49. The remainder of the trigger cover 1 closely engages the frame 62 of the gun 60

Figure 4:
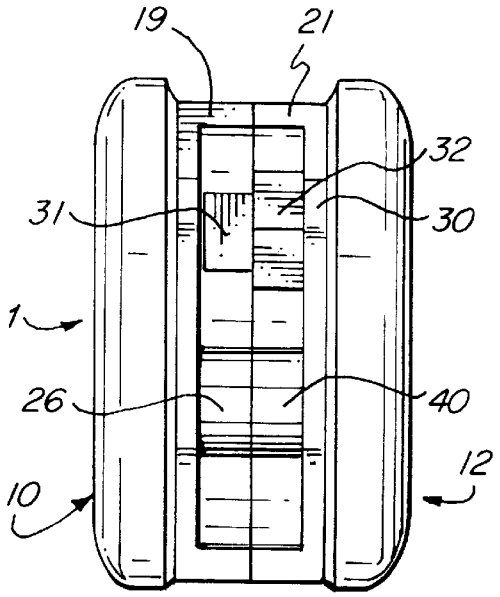
FIG. 4 is a top view of the trigger cover of FIG. 1, without the gun.

FIG. 4 shows the half-shells 10, 12 from the top in a matingly engaged position, as when engaged upon the trigger guard 51 of the gun 60. Thus, from FIGS. 1–4, it is shown that the present invention substantially encloses the trigger guard 51 of gun 60. As will become apparent by the discussion below, when the trigger cover 1 is in place, i.e., substantially enclosing the trigger guard, the trigger 50 is also immobilized from forward or rearward movement.

Figure 5:
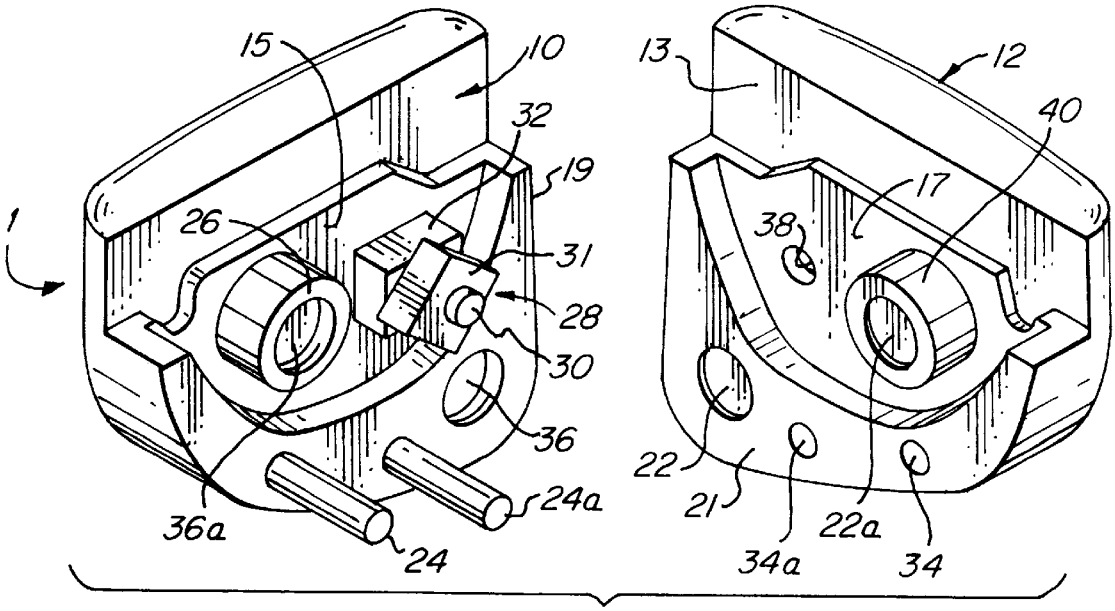
FIG. 5 is a perspective view of the trigger cover of FIG. 1 with its two half-shells pulled apart.
Figure 6:
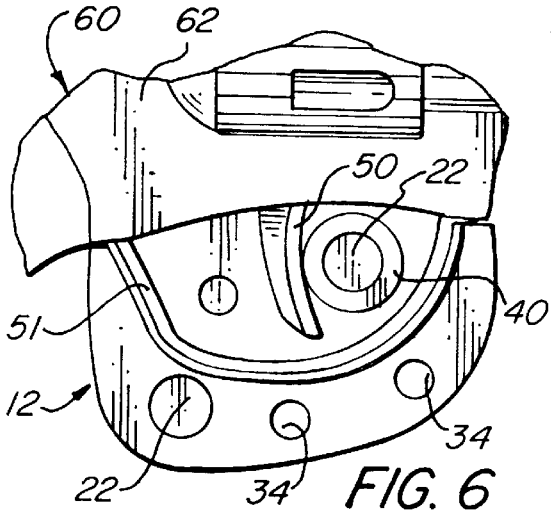
FIG. 6 is a side elevation view of one half-shell of the trigger cover of FIG. 1 in place on the trigger guard of the gun.
Figure 7:
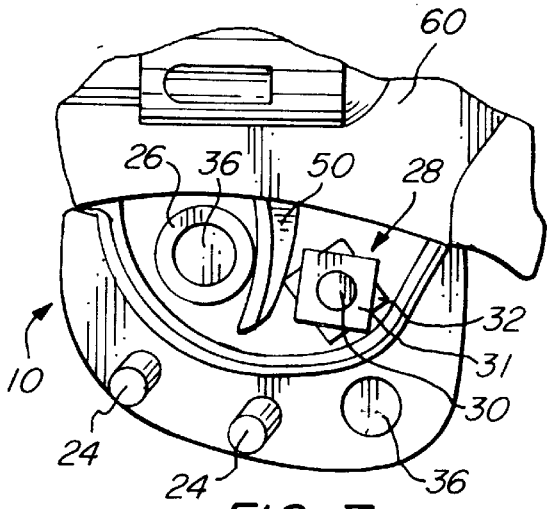
FIG. 7 is a side elevation view of one half-shell of the trigger cover of FIG. 1 in place on the trigger guard of the gun.
Figure 8:
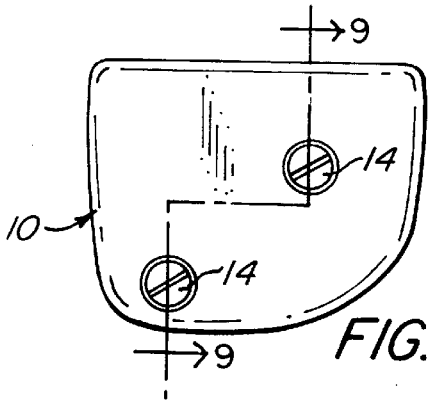
FIG. 8 is a side elevation view of the trigger cover of FIG. 1, without the gun.
Figure 10:
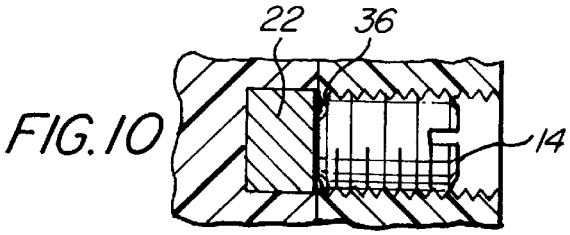
FIG. 10 is a fragmentary portion of the cross-sectional view of the trigger cover shown in FIG. 9.
Figure 9:
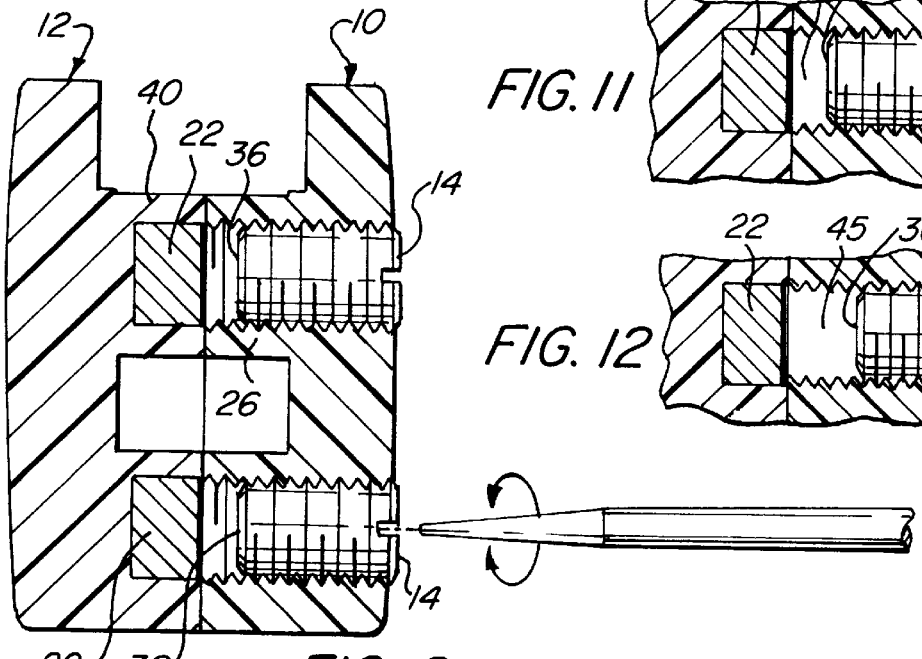
FIG. 9 is a cross-sectional view of the trigger cover of FIG. 1, taken along the lines 9—9 of FIG. 8.

In order to describe the cooperation between the various interior parts of the trigger cover 1 which immobilize trigger 50, reference is made to FIGS. 5–7. FIG. 6 shows female half-shell 12 having a left fixed trigger blocking post 40 extending from the left side wall 13 into cavity 17, positioned to prevent forward movement of the trigger 50. The trigger blocking post 40 together with the flange 19 embrace the trigger guard 51. FIG. 7 shows male half-shell 10 in relation to a typical trigger 50. It has a right fixed trigger blocking post 26, that meets the left fixed trigger blocking post 40, to cooperate with post 40 in preventing forward movement of trigger 50 and embracing the trigger guard 51. This is also seen in FIGS. 4 and 9.

As is readily seen in FIG. 7, the trigger cover 1 also prevents rearward movement of the trigger 50. Rotatable spacer pieces 31, 32 are eccentrically mounted on shaft 30 are thereby adjustable to fit securely behind trigger 50. These pieces together form an adjustable trigger blocking post 28. At least one trigger post receiving cavity 38 is located within left cavity 17 for receiving the tip end of adjustable trigger blocking post 28. Thus, the trigger 50 is immobilized by being positioned between rotatable eccentric spacer pieces 31, 32 of the adjustable trigger blocking post and the abutting right and left fixed trigger blocking posts 26, 40.

The right half-shell 10 and the left half-shell 12 are held together embracing the trigger 50 and trigger guard 51 by magnetic force. One magnetic catch piece 36 is located within right flange 19, facing the left flange 21. Within right cavity 15, the right fixed trigger blocking post 26 has magnetic catch piece **36*a* located in its center. The magnetic catch pieces 36, 36*a* may be a magnet, a piece of ferrous metal, or other magnetically attractable material mounted to threaded screws 14, 14*a*. In the embodiment shown, the catch pieces 36, 36*a* are the threaded studs 14, 14*a* themselves. The threaded studs integrally comprising magnetic catch pieces 36, 36*a* are magnetically attracted to magnets 22, 22*a* mounted in the female half-shell 12, in order to provide a force which binds the half-shells together. Magnet 22 is located in left flange 21 substantially adjacent catch piece 36 when the half-shells are engaged together, for attracting magnetic catch piece 36 as discussed above. Also located within left cavity 17 is the left fixed trigger blocking post 40, with magnet 22*a* located within left fixed trigger blocking post 40, for abutting the right fixed trigger blocking post 26 and establishing magnetic attraction with catch piece 36*a***.

The preferred magnets 22, **22*a* are of the rare earth type, preferably Neodymium magnets. They are very powerful for their size and weight and are easily cut to shape and installed. They are also not brittle, and do not break if the trigger cover 1** is dropped or given rough treatment.

The right half-shell and left half-shell making up trigger cover 1 are engageable and separable by axial movement. By axial movement, it is meant that the movement is along the lines of maximum magnetic attraction, i.e., the magnets and catch pieces must be pulled apart rather than being slid out of alignment, although trigger covers without this feature are also contemplated. To this end, right flange 19 has spaced apart guide posts 24, **24*a* extending therefrom. Within left flange 21 are located guide peg openings 34, 34*a* for respectively receiving guide pegs 24, 24*a* of the male half-shell when the half-shells 10, 12 are matingly engaged. This engagement using the guide pegs 24, 24*a* limits the half-shells 10, 12 to join and pull apart in a substantially axial manner. By only allowing one possible direction, i.e., substantially linear axial movement, to separate the half-shells 10, 12, it is more difficult to separate the half-shells and also requires a consistent separating force. For instance, the half-shells cannot be separated by prying under a cover of one half-shell because the guide posts do not permit sufficient skewing to achieve separation. However, the invention can also be carried out by using a stronger magnetic force in lieu of controlling the manner of separation. Thus, in summary, it has been described how the half-shells 10, 12 and various parts therein cooperate to immobilize and substantially enclose the trigger 51 when they are matingly engaged on a gun 60** such as a revolver.

It is desirable that the force necessary to separate the half-shells 10, 12 to remove the trigger cover 1 be adjustable. With reference to FIGS. 9–13, threaded studs 14, **14*a* are used to adjust the amount of magnetic force magnetically attracting the male half-shell 10 to the female half-shell 12 by moving magnetic catch piece(s) 36, 36*a* which are integrally part of threaded studs 14, 14*a* away from or towards magnets 22, 22*a*. There are gaps 45, 45*a* formed between the magnets 22, 22*a* and catch pieces 36, 36*a* and the threaded studs adjust the size of the gaps. Thus, in operation, by turning threaded stud 14 counter-clockwise, magnetic catch piece 36 is moved away from magnet 22. This widens gap 45 and weakens the magnetic attraction. Similarly, the threaded stud 14*a* may be rotated to adjust the size of the gap and magnetic attraction between magnet 22*a* and catch piece 36*a*. The adjustment may be carried out from the exterior of the trigger cover 1, as schematically illustrated in FIG. 9**.

Figure 11:
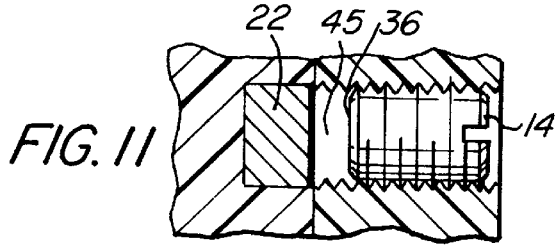
FIG. 11 is a fragmentary portion of the cross-sectional view of the trigger cover shown in FIG. 8, with an adjusted gap.
Figure 12:
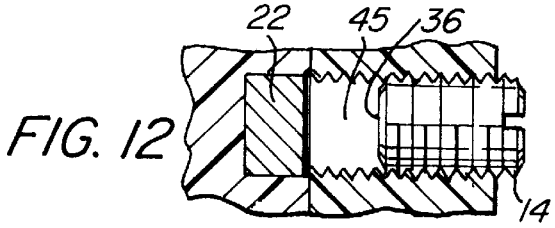
FIG. 12 is a fragmentary portion of the cross-sectional view of the trigger cover shown in FIG. 8, with an adjusted gap.

This enables an aspect of the invention which is to provide an adjustable level of force required to separate the half-shells 10, 12 comprising the trigger cover 1. In this way, an adult can set the level of force desired to use for the trigger cover based upon the user's own requirements. For example, an adult may be physically strong by ordinary standards and a child may be very young and thus much weaker than an ordinary adult. In this case, the trigger cover could be set to maximum force by turning threaded stud 14 to the position shown in FIG. 10, i.e., with a "zero" gap 45 present. Thereby the strong adult can quickly and quietly separate the half-shells 10, 12 with urgency, while the child would not be physically able to separate the half-shells. Thus, the arrangement of the present invention enables another aspect of the invention which is to deter children from firing the gun. The adjusted positions of threaded stud 14 shown in FIGS. 11 and 12 provide larger gaps and a somewhat reduced force necessary for separating the half-shells 10 and 12, which are still difficult to separate, but which may better suit the gun owner.

The outside surfaces of the half-shells are made to be smooth to the touch without a convenient gripping configuration, and the half-shells 10, 12 join at 49 without disruption of the smooth surface. This also contributes to the difficulty of separating the device for purposes of child safety, and also contributes to the requirement of a consistent separation force.

Therefore, although the invention has been described with respect to a preferred embodiment thereof, it will be understood by those skilled in the art that the foregoing and various other changes, omissions and deviations in the form and detail thereof may be made without departing from the spirit and scope of this invention, which is limited only by the following claims.

What is claimed is:

1. A trigger cover for a gun having a frame, a trigger guard mounted on the frame, and a trigger located within the trigger guard, the trigger cover comprising:

two complementary and separable half-shells which are matingly engageable and which together define a cavity between the half-shells, the cavity sized and configured to substantially receive and enclose and immobilize the trigger;

one of the half-shells including at least one magnet and the other of the half-shells including at least one of a magnet or a magnetic catch piece cooperating to magnetically attract the half-shells together when the half-shells are matingly engaged;

wherein the half-shells are separable by applying force sufficient to overcome the force of the magnetic attraction between the half-shells for removing the trigger cover and exposing the and trigger.

2. A trigger cover as defined in claim 1 wherein the half-shells also substantially receive and enclose the trigger guard.

3. A trigger cover as defined in claim 2 wherein an outside surface of the engaged half-shells is substantially smooth, whereby a substantially consistent amount of grip and strength is required to separate the engaged magnetically attracted half-shells.

4. A trigger cover as defined in claim 2, wherein the magnetic attraction generated by the least one magnet is adjustable.

5. A trigger cover as defined in claim 3, wherein the magnetic attraction is adjustable by adjusting a gap between the at least one magnet and the magnet or magnetic catch piece.

6. The trigger cover as defined in claim 5, wherein the gap is adjustable by at least one threaded stud mounting or comprising a magnet or magnetic catch piece, the threaded stud received in one of the half-shells.

7. The trigger cover as defined in claim 2, wherein two magnets and two catch pieces are used to matingly engage the half-shells.

8. The trigger cover as defined in claim 7, wherein the magnets are rare earth magnets.

9. The trigger cover as defined in claim 1, wherein the magnets are rare earth magnets.

10. The trigger cover as defined in claim 9, wherein the magnets are Neodymium magnets.

11. A trigger cover as defined in claim 1, wherein the half-shells are configured separate axially with respect to the at least one magnet and the at least one magnet or catch piece.

12. A trigger cover as defined in claim 11, wherein one of the half-shells has guide pegs extending therefrom and the other of the half-shells has openings receiving the guide pegs, such that the guide pegs and guide peg openings limit disengagement of the half-shells to an axial motion with respect to the magnetic attraction between the half-shells.

13. The trigger cover of claim 2, wherein at least one of the half-shells comprises at least one blocking post positioned to immobilize the trigger.

14. The trigger cover as defined in claim 13, wherein the half-shells comprise two blocking posts, and the trigger is immobilized between the two blocking posts.

15. The trigger cover as defined in claim 14, wherein one of the blocking posts includes adjustable spacer means to adapt the trigger cover to immobilizing the triggers on a variety of guns.

16. A trigger cover as defined in claim 13, wherein each of the half-shells defines at least one fixed blocking posts and the blocking posts abut to immobilize the trigger when the half-shells are engaged, and one of the fixed blocking posts mounts the at least one magnet and the other fixed blocking post mounts the at least one magnet of catch piece.

17. A trigger cover as defined in claim 16, wherein each of the half-shells comprises a flange and the flanges abut to enclose the trigger guard when the half-shells are engaged, and one of the flanges mounts a second magnet and the other flange mounts a second magnet or magnetic catch piece position for magnetic attraction with the magnet of the first flange.

18. A trigger cover for a gun having a frame, a trigger guard mounted on the frame, and a trigger located within the trigger guard, the trigger cover comprising:

a male half-shell and a complementary female half-shell, which are matingly engageable and separable with axial movement and which define a cavity there between for substantially receiving and enclosing the trigger guard and the trigger;

each half-shell having a side wall and a flange extending from the side wall to meet the flange of the other half-shell and substantially enclose the trigger guard on the gun when the half-shells are matingly engaged;

the male half-shell having at least one guide peg extending from its flange along the direction of axial movement for engagement and separation of the half-shells;

the female half-shell having at least one guide peg openings defined by its flange for receiving and aligning the at least one guide peg extending from the male half-shell to align the half-shells and form the trigger cover with a smooth exterior surface along the trigger guard when the half-shells are matingly engaged;

one of the half-shells having two magnets located to magnetically engage with two catch pieces mounted in the other half-shell when the half-shells are matingly engaged;

one of the half-shells having a fixed trigger blocking post extending from its side wall into the cavity and an adjustable trigger blocking post extending from its side wall into the cavity so tat the two posts together cooperate to prevent the trigger from moving fore or aft; and the adjustable trigger blocking post includes at least one rotatable eccentric spacer piece located on a shaft for adapting the adjustable trigger blocking post to differently positioned triggers by rotating the eccentric spacer piece to adjust a space for receiving a trigger between the eccentric spacer piece and the non-adjustable trigger post.

19. A trigger cover as defined in claim 18, wherein the fixed trigger post includes a portion extending from the side wall of the other half-shell, and one of the magnets and one of the catch pieces are respectively mounted in abutting portions of the fixed trigger blocking post.

20. The trigger cover as defined in claim 19, wherein the magnets are rare earth magnets.

21. A trigger cover for a gun having a frame, a trigger guard mounted on the frame, and a trigger located within the trigger guard, the trigger cover comprising:

two complementary and separable half-shells which are matingly engageable with substantially axial movement and which together define a cavity between the half-shells, the cavity sized and configured to substantially receive and enclose the trigger guard and immobilize the trigger;

magnetic means holding the half-shells together.

22. A trigger cover as defined in claim 21, wherein the magnetic means holding the half-shells together is adjustable.

23. A trigger cover as defined in claim 22, wherein the magnetic means comprises at least one rare earth magnet.

* * * * *